US010808579B2

(12) United States Patent
Ting et al.

(10) Patent No.: US 10,808,579 B2
(45) Date of Patent: Oct. 20, 2020

(54) HYBRID VALVE TRAIN SYSTEM

(71) Applicant: Cummins Inc., Columbus, IN (US)

(72) Inventors: Darren Yaoshun Ting, Columbus, IN (US); David M. Barnes, Columbus, IN (US)

(73) Assignee: Cummins Inc., Columbus, IN (US)

( * ) Notice: Subject to any disclaimer, the term of this patent is extended or adjusted under 35 U.S.C. 154(b) by 0 days.

(21) Appl. No.: 16/661,158

(22) Filed: Oct. 23, 2019

(65) Prior Publication Data

US 2020/0056514 A1 Feb. 20, 2020

Related U.S. Application Data

(63) Continuation of application No. PCT/US2018/032657, filed on May 15, 2018.

(60) Provisional application No. 62/506,327, filed on May 15, 2017.

(51) Int. Cl.

| | |
|---|---|
| ***F01L 1/14*** | (2006.01) |
| ***F01L 1/24*** | (2006.01) |
| ***F01L 1/053*** | (2006.01) |
| ***F01L 1/18*** | (2006.01) |
| ***F01L 1/26*** | (2006.01) |
| ***F01L 13/00*** | (2006.01) |
| ***F01L 13/06*** | (2006.01) |
| ***F02D 13/02*** | (2006.01) |

(Continued)

(52) U.S. Cl.

CPC ..... *F01L 1/2405* (2013.01); *F01L 1/053* (2013.01); *F01L 1/143* (2013.01); *F01L 1/185* (2013.01); *F01L 1/265* (2013.01); *F01L 1/267* (2013.01); *F01L 13/0005* (2013.01); *F01L 13/065* (2013.01); *F02D 13/0207* (2013.01); *F02D 13/04* (2013.01); *F02D 13/06* (2013.01); *F01L 2001/0537* (2013.01); *F01L 2001/2444* (2013.01); *F01L 2013/001* (2013.01); *F01L 2305/00* (2020.05)

(58) Field of Classification Search

CPC ..... F01L 1/2405; F01L 1/053; F01L 1/143; F01L 1/185; F01L 1/265; F01L 1/267; F01L 13/0005; F01L 13/065; F01L 2001/0537; F01L 2001/2444; F01L 2013/001; F01L 2105/00; F02D 13/0207; F02D 13/04; F02D 13/06

See application file for complete search history.

(56) References Cited

U.S. PATENT DOCUMENTS

| | | | |
|---|---|---|---|
| 4,721,074 | A | 1/1988 | Wirth et al. |
| 5,647,312 | A | 7/1997 | Salber et al. |

(Continued)

OTHER PUBLICATIONS

Search Report and Written Opinion, PCT Appln. No. PCT/US18/32657, dated Aug. 7, 2018, 8 pgs.

*Primary Examiner* — Zelalem Eshete

(74) *Attorney, Agent, or Firm* — Taft Stettinius & Hollister LLP

(57) ABSTRACT

For a given cylinder in the engine having two intake valves and two exhaust valves, one of the intake valves is driven by a bucket tappet, while the other intake valve is actuated via a roller finger follower. Similarly, one of the exhaust valves is driven by a bucket tappet, while the other exhaust valve is actuated via a roller finger follower. The intake valves read inputs form an intake camshaft, and the exhaust valves read inputs from an exhaust camshaft.

20 Claims, 6 Drawing Sheets

(51) Int. Cl.
*F02D 13/04* (2006.01)
*F02D 13/06* (2006.01)

(56) References Cited

U.S. PATENT DOCUMENTS

| | | | | |
|---|---|---|---|---|
| 6,415,752 | B1 * | 7/2002 | Janak | F01L 1/181 123/90.12 |
| 6,470,583 | B2 | 10/2002 | Itaya | |
| 6,981,476 | B2 | 1/2006 | Saretto et al. | |
| 8,307,806 | B2 | 11/2012 | Mariano et al. | |
| 8,662,034 | B2 | 3/2014 | Cuniberti et al. | |
| 8,789,502 | B2 | 7/2014 | Barnes | |
| 9,399,964 | B2 | 7/2016 | Younkins et al. | |

* cited by examiner

HYBRID VALVE TRAIN SYSTEM

CROSS-REFERENCE TO RELATED APPLICATION

The present application is a continuation of International Patent Application No. PCT/US18/32657, filed May 15, 2018, which claims the benefit of the filing date of U.S. Provisional Application No. 62/506,327 filed on May 15, 2017, each of which is incorporated herein by reference.

TECHNICAL FIELD

The present disclosure relates generally to valve train systems for an internal combustion engine, and more particularly but not exclusively to a hybrid valve train system incorporating bucket tappet and roller finger follower types of valve actuation mechanisms.

BACKGROUND

Overall breadth and height of engines are now of increasing importance as the engine market demands increasing power densities in modern engines. To address this demand, any technological valve train should provide for improved fuel economy, compression braking, serviceability and a reduced Noise Vibration and Harshness (NVH). Particularly, a valve train further is preferred that can be implemented as a minimally-sized package, which minimizes a height and/or a width footprint of an engine.

SUMMARY

The present application incorporates a hydraulic lash adjuster (HLA) in a valve train for the primary benefit of less noise being attenuated from the valve train since the HLA eliminates valve train clearance (lash) under all or certain operating conditions. Furthermore, HLA eliminates a typical valve adjustment process both at the assembly plant and in service thereby reducing manufacturing and servicing costs.

The present application further describes an HLA that enables cylinder deactivation functionality, which is used to reduce the fuel consumption and emissions of internal combustion engines during light-load operation. Normal operation without cylinder deactivation during light load is wasteful because fuel is continuously pumped into each cylinder and combusted even though maximum performance is not required. By shutting down some of an engine's cylinders, the amount of fuel consumed is reduced.

Other described technologies include an HLA for compression braking and independent cam phasing.

This summary is provided to introduce a selection of concepts that are further described below in the illustrative embodiments. This summary is not intended to identify key or essential features of the claimed subject matter, nor is it intended to be used as an aid in limiting the scope of the claimed subject matter. Further embodiments, forms, objects, features, advantages, aspects, and benefits shall become apparent from the following description and drawings.

DESCRIPTION OF ILLUSTRATIVE EMBODIMENTS

Figure 1B:
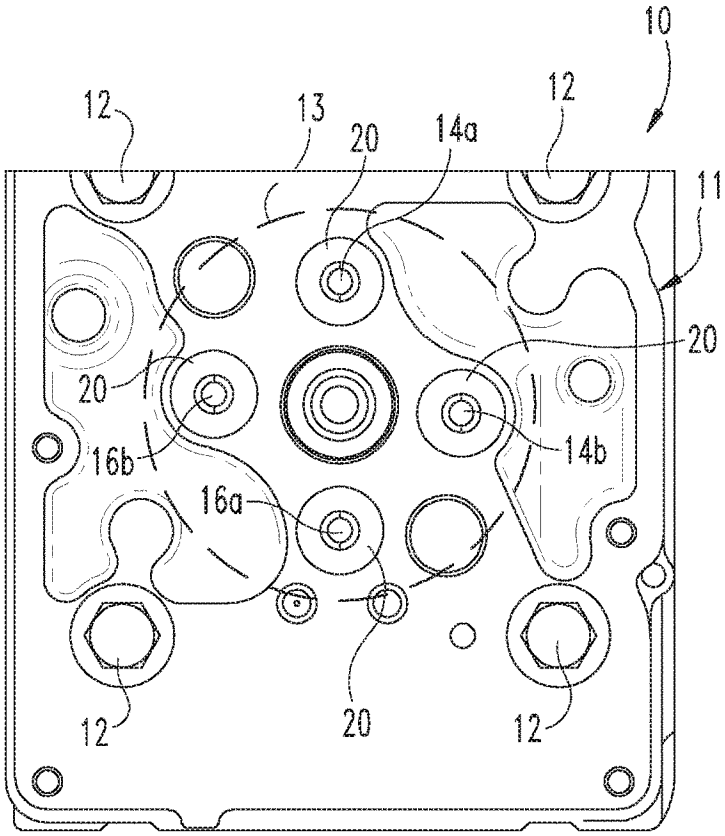
FIG. 1B is a top view of the cylinder head and the part of the valve assembly of shown in FIG. 1A.

For the purposes of promoting an understanding of the principles of the invention, reference will now be made to the embodiments illustrated in the drawings and specific language will be used to describe the same. It will nevertheless be understood that no limitation of the scope of the invention is thereby intended, any alterations and further modifications in the illustrated embodiments, and any further applications of the principles of the invention as illustrated therein as would normally occur to one skilled in the art to which the invention relates are contemplated herein.

Generally, the present application is directed to a combination of a type-2 roller finger follower system in conjunction with a type-1 bucket tappet system arranged in a compact and efficient way for actuating intake and exhaust valves and providing for service needs, variable valve actuation/variable valve timing (VVA/VVT) and compression brake needs on a non-square valve pattern. For a given cylinder in the engine, one intake valve is driven by a type-1 bucket tappet, while the other intake valve is actuated via a type-2 roller finger follower. Both these sub-assemblies read inputs from an intake cam. This same arrangement is replicated on the exhaust valves for the cylinder, where those sub-assemblies read inputs from an exhaust cam.

HLA and cylinder deactivation functionality is achieved in the type-1 tappet system through a deactivating bucket tappet that also includes an HLA element. Those same functionalities are achieved in the type-2 roller finger follower system with the use of another deactivating HLA. A compression brake system is also included in the layout of the hybrid valve train, and all of the above are housed/mounted on a tappet carrier. The tappet carrier also includes various oil passages that interface with the HLAs and VVA elements and switching solenoids to enable the on-off nature of VVA needs.

The tappet carrier directly interfaces with the cylinder head and is enclosed by a cam carrier, which houses camshafts that act upon the bucket tapper and roller finger follower systems. Independent cam phasing capability is provided for with dual overhead cams.

Figure 1A:
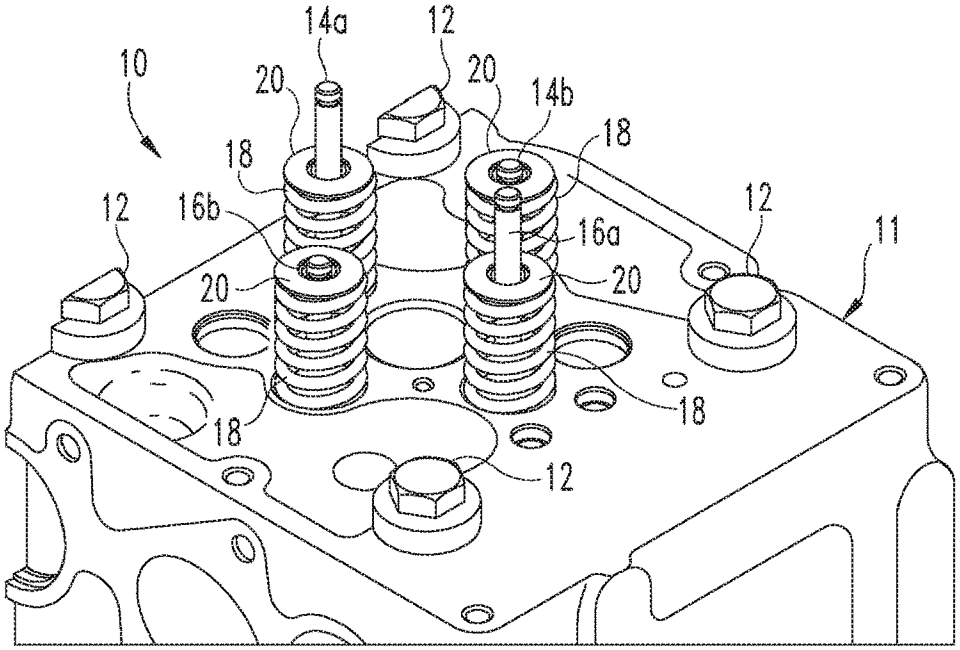
FIG. 1A is an isometric view of a cylinder head and a part of a valve assembly of the present disclosure.

In one embodiment of the present application, FIGS. 1A and 1B depict a segment of a cylinder head and valve assembly 10, which comprises a cylinder head 11, cylinder head bolts 12, first and second intake valves 14*a* and 14*b*, first and second exhaust valves 16*a* and 16*b*, valve springs 18 and valve spring retainers 20. Note that the intake valves 14*a* and 14*b* are of two different lengths in order to facilitate packaging of the type-1 and type-2 valve train components employed for the respective intake valve 14*a*, 14*b*. This is the same for the exhaust valves 16*a*, 16*b*. The intake valves 14*a*, 14*b* control air flow into a combustion chamber (not shown) of a cylinder 13 of an internal combustion engine, and the exhaust valves control exhaust flow out of the cylinder 13.

Figure 2B:
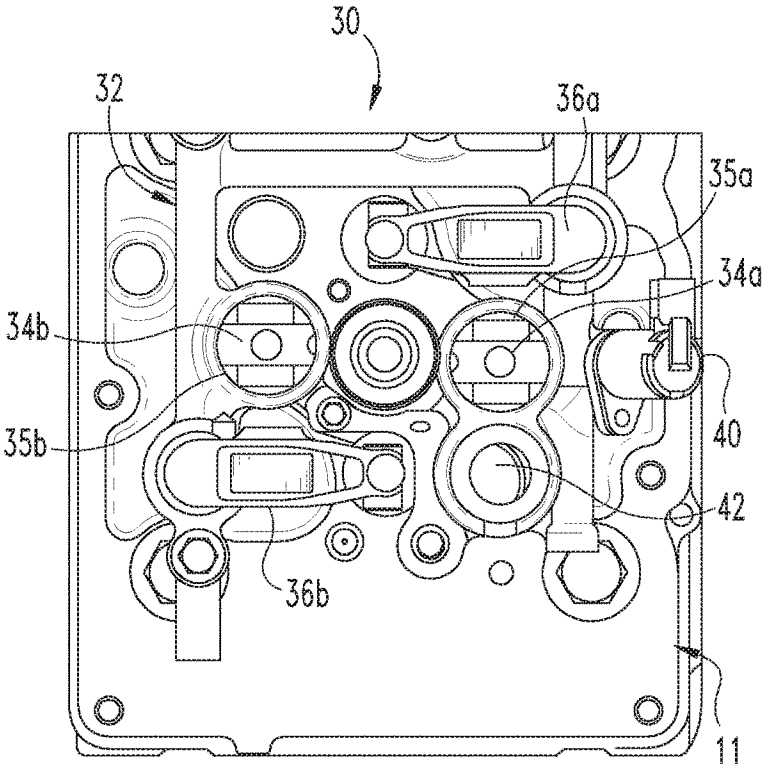
FIG. 2B is a top view of the cylinder head with the bucket tappet/roller finger follower assembly shown in FIG. 2A.
Figure 2A:
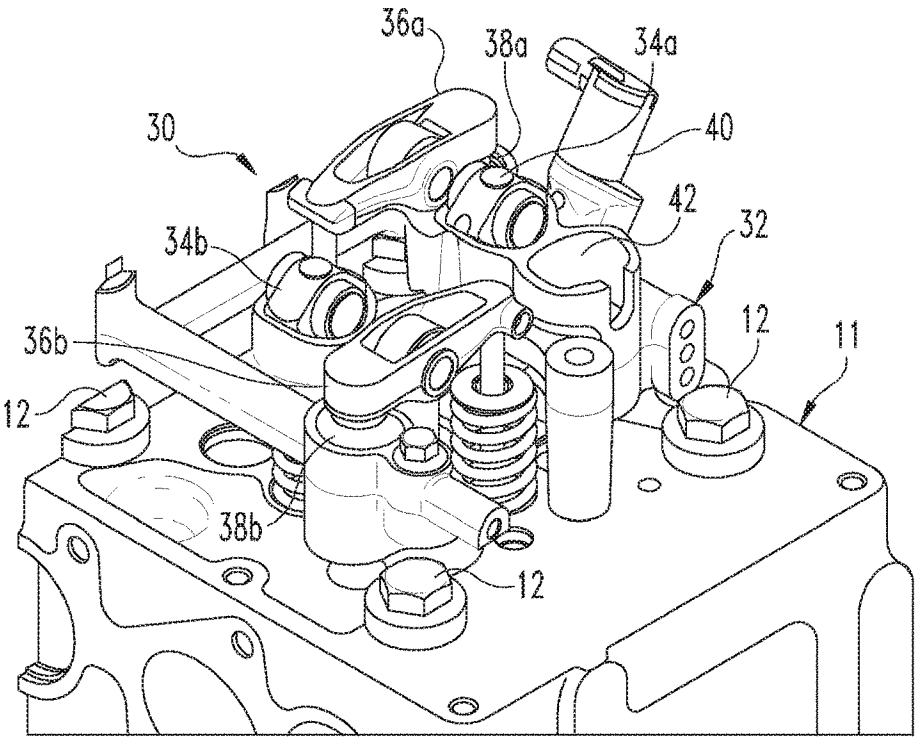
FIG. 2A is an isometric view of a bucket tappet/roller finger follower assembly of the present disclosure mounted to the intake and exhaust valves of FIG. 1A.

FIGS. 2A and 2B depict a segment of the tappet assembly 30 which bolts on top of the cylinder head and valve assembly 10 as a separate component. The tappet assembly 30 includes a tappet carrier 32 mounted to cylinder head 11. Tappet carrier 32 supports type-1 bucket tappets 34*a*, 34*b* which translate in a respective bore 35*a*, 35*b* machined into the tappet carrier 32 associated with respective ones of the intake and exhaust valves 14*b*, 16*b*. Tappet assembly 30 also includes type-2 roller finger followers 36*a*, 36*b* mounted to tappet carrier 32 which pivot on a respective HLA 38*a*, 38*b* that are also each housed in a bore machined into the tappet carrier 32. Also shown in FIGS. 2A and 2B is a switching solenoid 40 and the brake tappet bore 42.

Figure 3B:
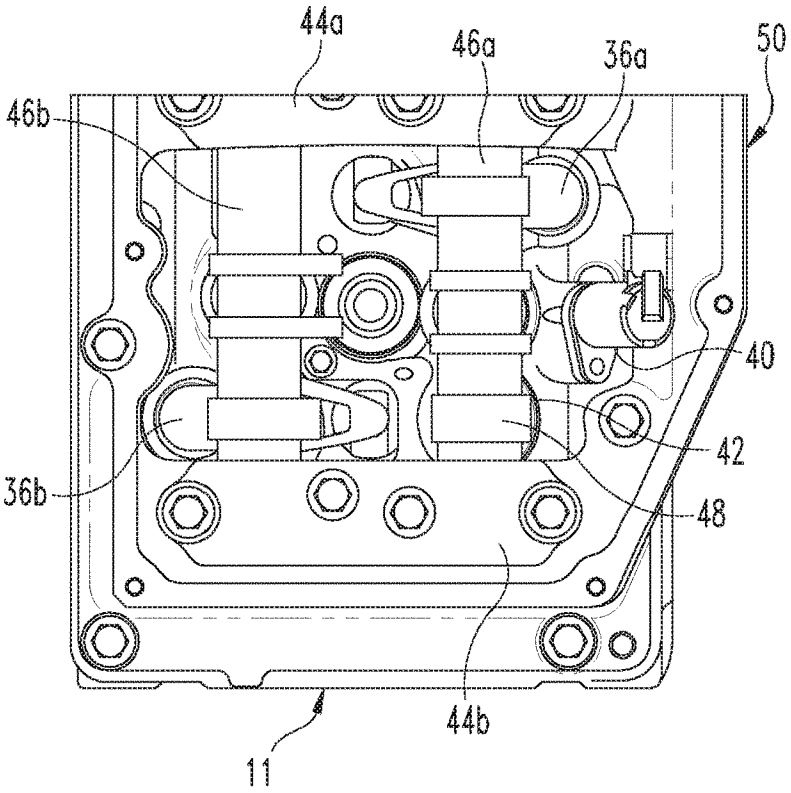
FIG. 3B is a top view of the cylinder head with the cam carrier assembly of shown in FIG. 3A.
Figure 3A:
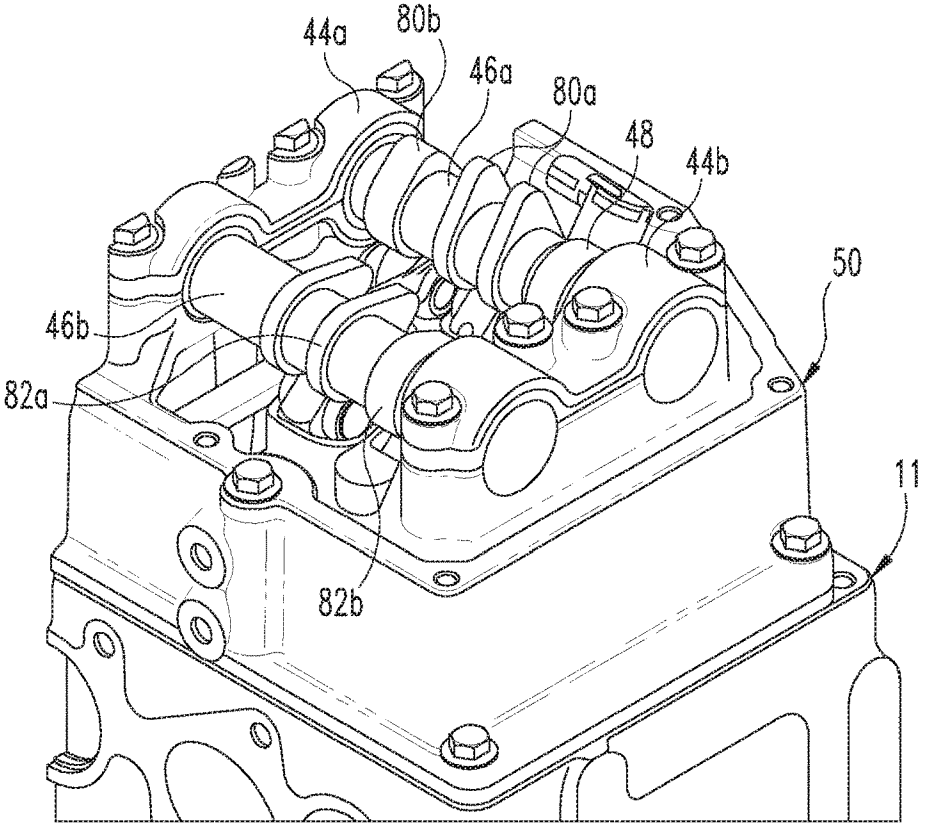
FIG. 3A is an isometric view of a cam carrier assembly of the present disclosure mounted to the cylinder head around the bucket tappet/roller finger follower assembly of FIG. 2A.

FIGS. 3A and 3B depict the assembly of a cam carrier 50 and camshafts 46*a*, 46*b* to the cylinder head 11 and tappet carrier 32. Shown in FIGS. 3A and 3B are the cam carrier 50 and cam caps 44*a*, 44*b*, which house the intake camshaft 46*a* and exhaust camshaft 46*b*. The intake and exhaust camshafts 46*a*, 46*b* are mounted high in the valve train system and include cam lobes that operate on the intake and exhaust bucket tappets 34*a*, 34*b* and roller finger followers 36*a*, 36*b*. The brake lobe 48 is located over brake tappet bore 42 and provides a braking lift profile to the brake tappet (not shown). Brake lobe 48 is located on the intake camshaft 46*a*, and is directly adjacent to the exhaust-side roller finger follower 36*b*. The layout as shown in FIGS. 3A and 3B enables a compact braking mechanism which is required in minimizing the footprint of the valve train components.

The intake camshaft 46*a* includes a bucket tappet intake lobe 80*a* operatively coupled to the bucket tappet 34*a* of intake valve 14*b* to execute a tappet intake lift profile that is defined by the lobe 80*a*. Intake camshaft 46*a* includes a roller finger follower intake lobe 80*b* operatively coupled to the roller finger follower 36*a* of intake valve 14*a* to execute a rocker intake lift profile defined by the lobe 80*b*. The exhaust camshaft 46*b* includes a bucket tappet exhaust lobe 82*a* operatively coupled to the bucket tappet 34*a* of exhaust valve 16*b* to execute a tappet exhaust lift profile defined by the lobe 82*a*. Exhaust camshaft 46*b* also includes a roller finger follower exhaust lobe 82*b* operatively coupled to the roller finger follower 36*b* of exhaust valve 16*a* to execute a rocker exhaust lift profile defined by the lobe 82*b*.

Figure 4B:
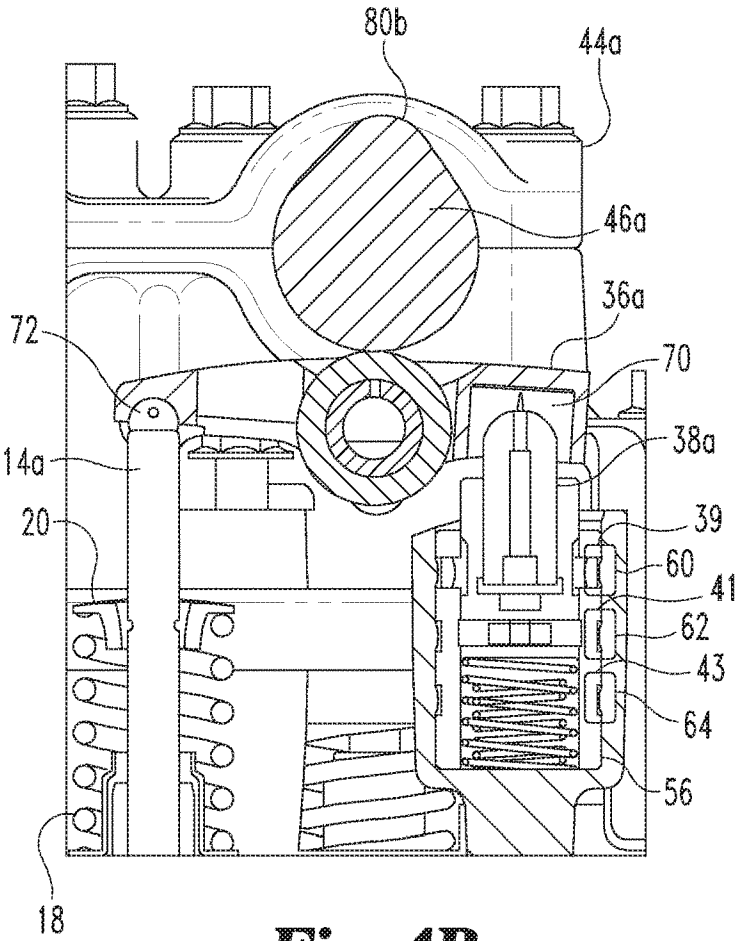
FIG. 4B is a partial section view of FIG. 3A looking in the direction of line 4B-4B shown in FIG. 4A.
Figure 4A:
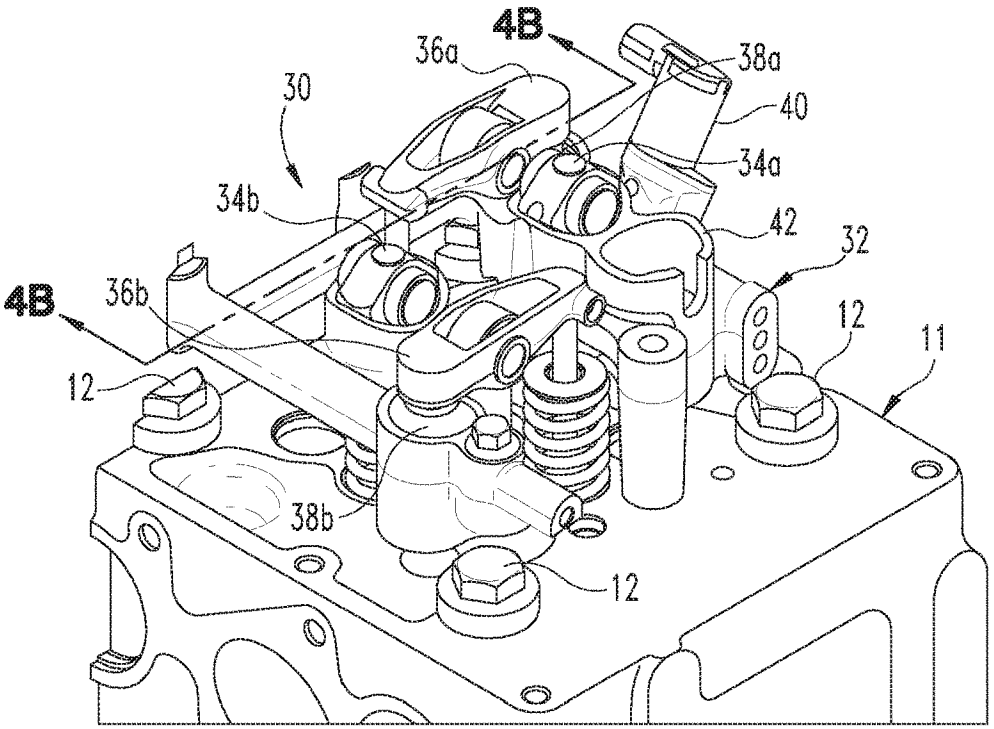
FIG. 4A is the isometric view of the tappet/roller finger follower assembly shown in FIG. 2A with a cross-section delineation.

As shown in FIG. 4B, which is a partial section view of FIG. 3A looking in the direction of line 4B-4B shown in FIG. 4A, the tappet carrier 32 provides a mounting bore 56 for the HLA 38*a* and a similar mounting bore (not shown) for HLA 38*b*. Tappet carrier 32 also includes a number of oil passages 60, 62, 64 to enable VVA functionality. There also may be provided various angled drillings (not shown) in tappet carrier 32 into first, second and third oil passages 60, 62, 64 that allow communication of oil pressure to the bucket tappets 34*a*, 34*b* and the brake tappet (not shown). As a result, the oil passages 60, 62, 64 interface with the bucket tappets 34*a*, 34*b*, the HLAs 38*a*, 38*b*, the brake tappets (not shown) and switching solenoids 40.

Figure 5A:
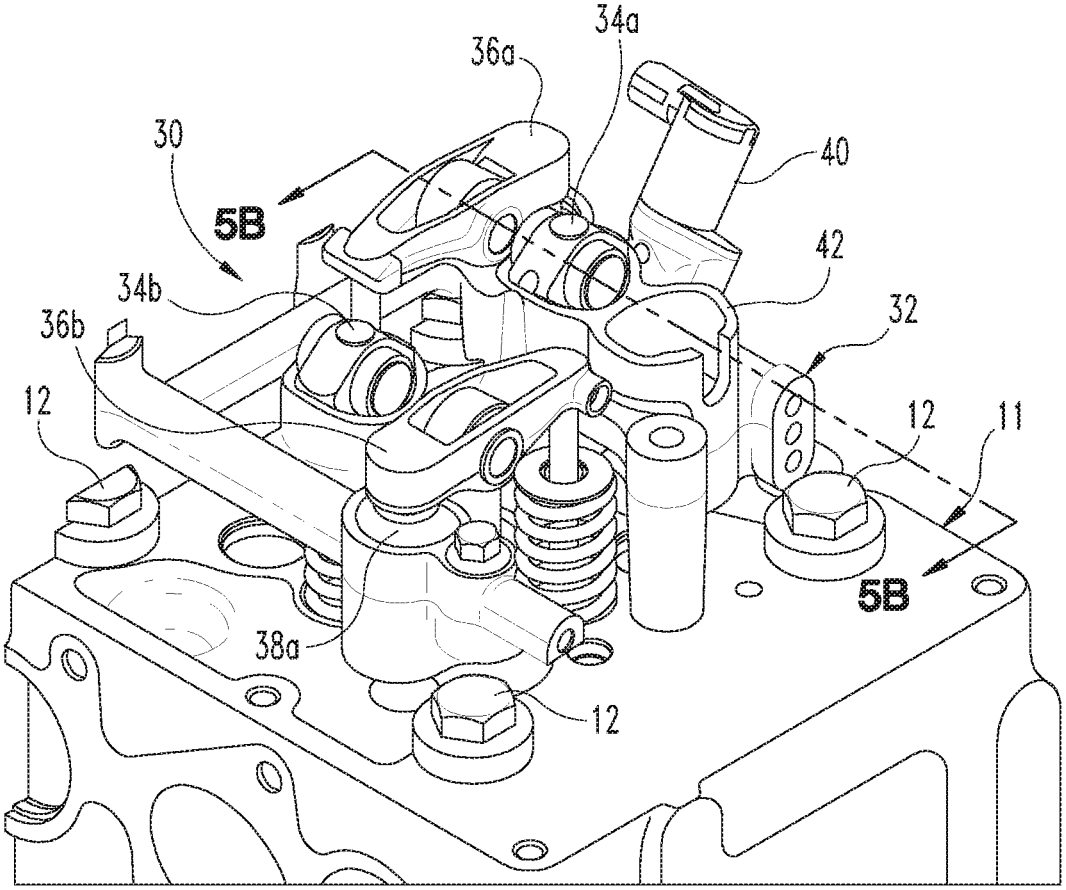
FIG. 5A is the isometric view of the tappet/roller finger follower assembly shown in FIG. 2A with a cross-section delineation.
Figure 5B:
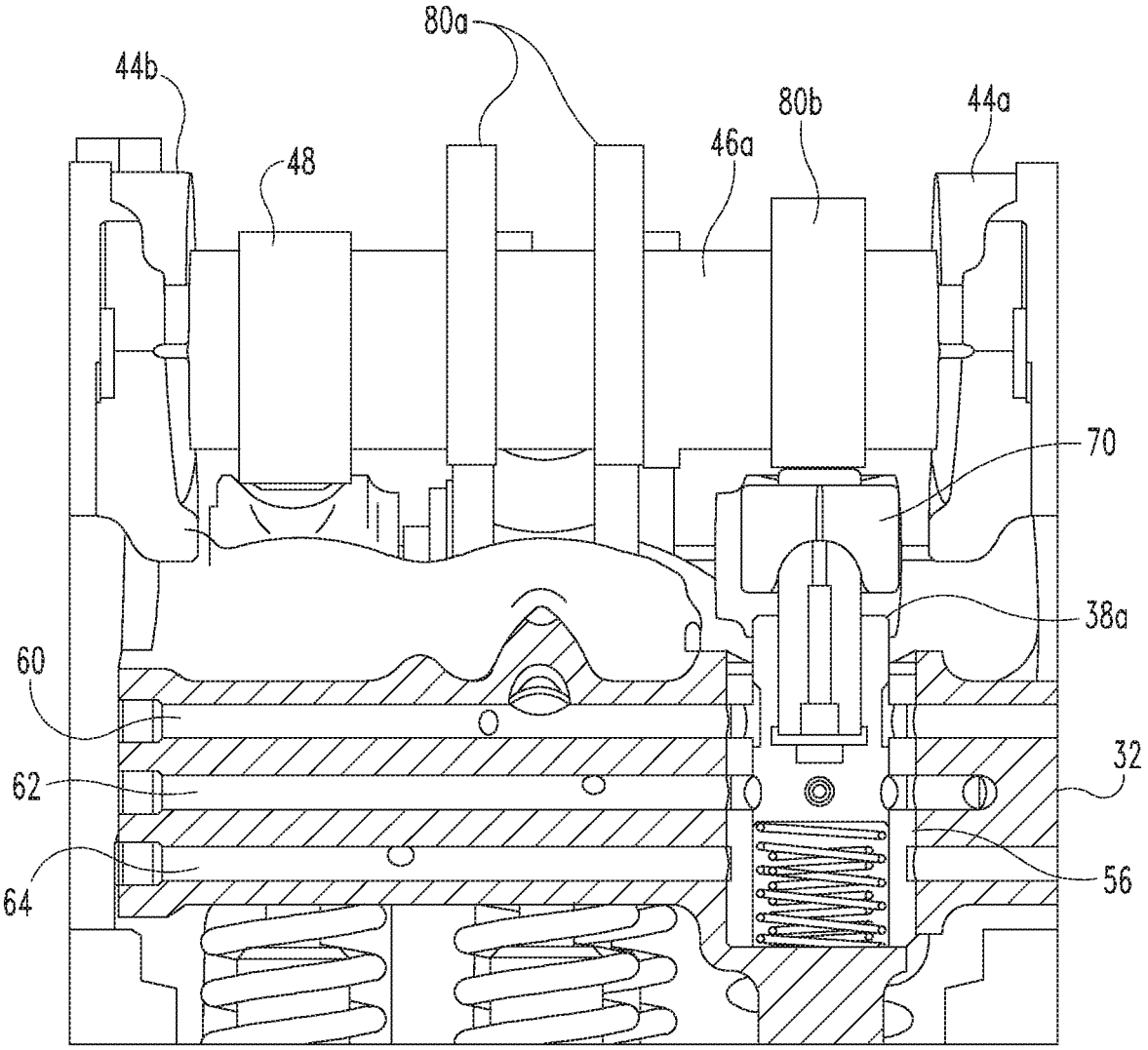
FIG. 5B is a partial section view of FIG. 3A looking in the direction of line 5B-5B shown in FIG. 5A.

Referring further to FIG. 5B, which is a partial section view of FIG. 3A looking in the direction of line 5B-5B of FIG. 5A, the roller finger follower 36*a* provides an assembly that includes an HLA insert 70 to interface with HLA 38 as well as a valve tip insert 72 to interface with the respective intake or exhaust valve stem. The inserts 70, 72 are included to allow the use of premium material where needed to improve wear resistance on components. Roller finger follower 36*b* may also be similarly configured.

FIG. 5B further shows the tappet carrier's oil passages from an intake-side view, where there are three tiers of oil passages: first oil passage 60 for HLA functionality, second oil passage 62 for deactivation, and compression braking oil passage 64. These oil passages 60, 62, 64 span across the tappet carrier 32 and oil is able to wrap around the axis of the HLA bores 56 via grooves 39, 41, 43 that are machined into the outer body of the respective HLA 38*a*, 38*b*.

During normal operation, a source of oil pressure from the cylinder head is provided to the HLA 38*a*, 38*b* and bucket tappets 34*a*, 34*b* (which also each house an HLA element) via the HLA oil passage 60, which enables the HLA to function as required. At this time, the deactivating oil passage 62 is primed with oil through an orifice (not shown) in the system, while the compression braking oil passage 64 is dry.

During cylinder deactivation, the switching solenoid 40 activates, providing oil pressure to the deactivating oil passage 62, which enables the deactivating mechanisms in the HLA 38*a*, 38*b* and bucket tappets 34*a*, 34*b*, and allows the engine to switch off the actuation of both intake and exhaust valves. When cylinder deactivation is no longer required, the switching solenoid 40 deactivates, cutting off oil pressure to the deactivation mechanisms. The various return mechanisms in the HLA 38*a*, 38*b* and bucket tappet 34*a*, 34*b* allow the components to return to a normal operating mode in the absence of oil pressure.

This working principle also applies to the compression braking functionality in the system. During compression braking, a separate switching solenoid (similar to solenoid 40) activates, providing oil pressure to the compression braking oil passage 64, which enables the braking mechanism in the brake tappet (not shown). As the switching solenoid deactivates, oil pressure is cut off, and the return mechanism in the brake tappet allows the component to return to a normal operating mode.

Various aspects of the present disclosure are contemplated. According to one aspect, a hybrid valve train for a cylinder of an internal combustion engine is provided that includes a cylinder head and a valve assembly mounted to the cylinder head. The valve assembly includes a first bucket tappet operably connected to a first intake valve, a first roller finger follower operably connected to a second intake valve, a second bucket tappet operably connected to a first exhaust valve, and a second roller finger follower operably connected to a second exhaust valve.

In one embodiment, the hybrid valve train includes an intake camshaft with a bucket tappet intake lobe operatively coupled to the first bucket tappet of the first intake valve to execute a tappet intake lift profile, and a roller finger follower intake lobe operatively coupled to the first roller finger follower of the second intake valve to execute a rocker intake lift profile. In a refinement of this embodiment, the hybrid valve train includes an exhaust camshaft with a bucket tappet exhaust lobe operatively coupled to the second bucket tappet of the first exhaust valve to execute a tappet exhaust lift profile, and a roller finger follower exhaust lobe operatively coupled to the second roller finger follower of the second exhaust valve to execute a rocker exhaust lift profile. In yet a further refinement of these embodiments, the hybrid valve train includes a cam carrier mounted to the cylinder head and the intake camshaft and the exhaust cam shaft are mounted to the cam carrier. In another embodiment, the intake camshaft includes a brake lobe to execute a brake lift profile.

In yet another embodiment, the hybrid valve train includes a tappet carrier mounted to the cylinder head. The first bucket tappet of the first intake valve and the second bucket tappet operatively translate within the tappet carrier. The first roller finger follower is operatively connected to a first hydraulic lash adjuster housed within the tappet carrier, and the second roller finger follower is operatively connected to a second hydraulic lash adjuster housed within the tappet carrier. In a refinement of this embodiment, the tappet carrier includes a variable valve actuation oil passage in fluid communication with at least one of the first bucket tappet, the second bucket tappet, the first hydraulic lash adjuster, and the second hydraulic lash adjuster to execute a variable valve actuation. In yet a further refinement, the tappet carrier includes a cylinder deactivation oil passage in fluid communication with at least one of the first bucket tappet, the second bucket tappet, the first hydraulic lash adjuster, and the second hydraulic lash adjuster to execute a cylinder deactivation. In yet a further refinement, the tappet carrier includes a compression brake oil passage.

In another refinement of the hybrid valve train with the tappet carrier, the hybrid valve train includes an intake camshaft with a bucket tappet intake lobe operatively coupled to the first bucket tappet of the first intake valve to execute a tappet intake lift profile, and a roller finger follower intake lobe operatively coupled to the first roller finger follower of the second intake valve to execute a rocker intake lift profile. The hybrid valve train also includes an exhaust camshaft with a bucket tappet exhaust lobe operatively coupled to the second bucket tappet of the first exhaust valve to execute a tappet exhaust lift profile, and a roller finger follower exhaust lobe operatively coupled to the second roller finger follower of the second exhaust valve to execute a rocker exhaust lift profile. In a further refinement, the hybrid valve train includes a cam carrier mounted to the cylinder head around the tappet carrier, and the intake camshaft and the exhaust cam shaft are mounted to the cam carrier.

According to another aspect of the present disclosure, a hybrid valve train for a cylinder of an internal combustion engine includes a cylinder head and a valve assembly mounted to the cylinder head. The valve assembly includes a bucket tappet connected to a first intake valve and a roller finger follower connected to a second intake valve. The hybrid valve train also includes an intake camshaft with a bucket tappet intake lobe in contact with the bucket tappet of the first intake valve to execute a tappet intake lift profile, and a roller finger follower intake lobe in contact with the roller finger follower of the second intake valve to execute a rocker intake lift profile.

In one embodiment of the hybrid valve train, the valve assembly further includes a second bucket tappet operably connected to a first exhaust valve and a second roller finger follower connected to a second exhaust valve. In a refinement of this embodiment, the hybrid valve train includes an exhaust camshaft with a bucket tappet exhaust lobe in contact with the second bucket tappet of the first exhaust valve to execute a tappet exhaust lift profile, and a roller finger follower exhaust lobe in contact with the second roller finger follower of the second exhaust valve to execute a rocker exhaust lift profile. In a further refinement, the hybrid valve train includes a tappet carrier mounted to the cylinder head. The bucket tappet of the first intake valve and the second bucket tappet of the first exhaust valve are positioned within the tappet carrier, the roller finger follower of the second intake valve is connected to a first hydraulic lash adjuster housed within the tappet carrier, and the second roller finger follower of the second exhaust valve is connected to a second hydraulic lash adjuster within the tappet carrier. In still a further refinement, a cam carrier is mounted to the cylinder head around the tappet carrier, and the intake camshaft and the exhaust camshaft are mounted to the cam carrier.

According to another aspect of the present disclosure, a hybrid valve train for a cylinder of an internal combustion engine includes a cylinder head and a valve assembly mounted to the cylinder head. The valve assembly includes a bucket tappet operably connected to a first exhaust valve and a roller finger follower operably connected to a second exhaust valve. The hybrid valve train also includes an exhaust camshaft with a bucket tappet exhaust lobe in contact with the bucket tappet of the first exhaust valve to execute a tappet exhaust lift profile, and a roller finger follower exhaust lobe in contact with the roller finger follower of the second exhaust valve to execute a rocker exhaust lift profile.

In one embodiment, the hybrid valve train includes a tappet carrier mounted to the cylinder head. The bucket tappet of the first exhaust valve is positioned within the tappet carrier, and the roller finger follower of the second exhaust valve is connected to a hydraulic lash adjuster housed within the tappet carrier. In yet a further refinement, the hybrid valve train includes a cam carrier mounted to the cylinder head around the tappet carrier, and the exhaust cam shaft is mounted to the cam carrier. In another refinement, wherein the tappet carrier includes a variable valve actuation oil passage, a cylinder deactivation oil passage, and a compression brake oil passage in fluid communication with the hydraulic lash adjuster.

While the invention has been illustrated and described in detail in the drawings and foregoing description, the same is to be considered as illustrative and not restrictive in character, it being understood that only certain exemplary embodiments have been shown and described. Those skilled in the art will appreciate that many modifications are possible in the example embodiments without materially departing from this invention. Accordingly, all such modifications are intended to be included within the scope of this disclosure as defined in the following claims.

In reading the claims, it is intended that when words such as "a," "an," "at least one," or "at least one portion" are used there is no intention to limit the claim to only one item unless specifically stated to the contrary in the claim. When the language "at least a portion" and/or "a portion" is used the item can include a portion and/or the entire item unless specifically stated to the contrary.

What is claimed is:

1. A hybrid valve train for a cylinder of an internal combustion engine, comprising:

a cylinder head; and a valve assembly mounted to the cylinder head, the valve assembly including:

a first bucket tappet operably connected to a first intake valve, a first roller finger follower operably connected to a second intake valve, a second bucket tappet operably connected to a first exhaust valve, and a second roller finger follower operably connected to a second exhaust valve.

2. The hybrid valve train of claim 1, further comprising an intake camshaft including:

a bucket tappet intake lobe operatively coupled to the first bucket tappet of the first intake valve, and a roller finger follower intake lobe operatively coupled to the first roller finger follower of the second intake valve.

3. The hybrid valve train of claim 2, further comprising an exhaust camshaft including:

a bucket tappet exhaust lobe operatively coupled to the second bucket tappet of the first exhaust valve, and a roller finger follower exhaust lobe operatively coupled to the second roller finger follower of the second exhaust valve.

4. The hybrid valve train of claim 3, further comprising a cam carrier mounted to the cylinder head and the intake camshaft and the exhaust cam shaft are mounted to the cam carrier.

5. The hybrid valve train of claim 2, wherein the intake camshaft further includes a brake lobe.

6. The hybrid valve train of claim 1, further comprising:

a tappet carrier mounted to the cylinder head, wherein:

the first bucket tappet of the first intake valve and the second bucket tappet of the first exhaust valve operatively translate within the tappet carrier, and the first roller finger follower is operatively connected to a first hydraulic lash adjuster housed within the tappet carrier, and the second roller finger follower is operatively connected to a second hydraulic lash adjuster housed within the tappet carrier.

7. The hybrid valve train of claim 6, wherein the tappet carrier includes:

a variable valve actuation oil passage in fluid communication with at least one of the first bucket tappet, the second bucket tappet, the first hydraulic lash adjuster, and the second hydraulic lash adjuster.

8. The hybrid valve train of claim 7, wherein the tappet carrier includes:

a cylinder deactivation oil passage in fluid communication with at least one of the first bucket tappet, the second bucket tappet, the first hydraulic lash adjuster, and the second hydraulic lash adjuster.

9. The hybrid valve train of claim 8, wherein the tappet carrier further includes a compression brake oil passage.

10. The hybrid valve train of claim 6, further comprising:

an intake camshaft including:

a bucket tappet intake lobe operatively coupled to the first bucket tappet of the first intake valve, and a roller finger follower intake lobe operatively coupled to the first roller finger follower of the second intake valve; and an exhaust camshaft including:

a bucket tappet exhaust lobe operatively coupled to the second bucket tappet of the first exhaust valve, and a roller finger follower exhaust lobe operatively coupled to the second roller finger follower of the second exhaust valve.

11. The hybrid valve train of claim 10, further comprising a cam carrier mounted to the cylinder head around the tappet carrier, wherein the intake camshaft and the exhaust camshaft are mounted to the cam carrier.

12. A hybrid valve train for a cylinder of an internal combustion engine, comprising:

a cylinder head;

a valve assembly mounted to the cylinder head, the valve assembly including:

a bucket tappet connected to a first intake valve, a roller finger follower connected to a second intake valve; and an intake camshaft including:

a bucket tappet intake lobe in contact with the bucket tappet of the first intake valve to execute a tappet intake lift profile, and a roller finger follower intake lobe in contact with the roller finger follower of the second intake valve to execute a rocker intake lift profile.

13. The hybrid valve train of claim 12, wherein the valve assembly further comprises:

a second bucket tappet connected to a first exhaust valve, and a second roller finger follower connected to a second exhaust valve.

14. The hybrid valve train of claim 13, further comprising:

an exhaust camshaft including:

a bucket tappet exhaust lobe in contact with the second bucket tappet of the first exhaust valve to execute a tappet exhaust lift profile, and a roller finger follower exhaust lobe in contact with the second roller finger follower of the second exhaust valve to execute a rocker exhaust lift profile.

15. The hybrid valve train of claim 14, further comprising:

a tappet carrier mounted to the cylinder head, wherein:

the bucket tappet of the first intake valve and the second bucket tappet of the first exhaust valve are housed within the tappet carrier, and the roller finger follower of the second intake valve is connected to a first hydraulic lash adjuster housed within the tappet carrier, and the second roller finger follower of the second exhaust valve is connected to a second hydraulic lash adjuster housed within the tappet carrier.

16. The hybrid valve train of claim 15, further comprising a cam carrier mounted to the cylinder head around the tappet carrier, wherein the intake camshaft and the exhaust camshaft are mounted to the cam carrier.

17. A hybrid valve train for a cylinder of an internal combustion engine, comprising:

a cylinder head;

a valve assembly mounted to the cylinder head, the valve assembly including:

a bucket tappet operably connected to a first exhaust valve, a roller finger follower operably connected to a second exhaust valve; and an exhaust camshaft including:

a bucket tappet exhaust lobe in contact with the bucket tappet of the first exhaust valve to execute a tappet exhaust lift profile, and a roller finger follower exhaust lobe in contact with the roller finger follower of the second exhaust valve to execute a rocker exhaust lift profile.

18. The hybrid valve train of claim 17, further comprising:

a tappet carrier mounted to the cylinder head, wherein:

the bucket tappet of the first exhaust valve is positioned within the tappet carrier, and the roller finger follower of the second exhaust valve is connected to a hydraulic lash adjuster housed within the tappet carrier.

19. The hybrid valve train of claim 18, further comprising a cam carrier mounted to the cylinder head around the tappet carrier, wherein the exhaust cam shaft is mounted to the cam carrier.

20. The hybrid valve train of claim 18, wherein the tappet carrier includes a variable valve actuation oil passage, a cylinder deactivation oil passage, and a compression brake oil passage in fluid communication with the hydraulic lash adjuster.

* * * * *